US005415567A

United States Patent [19]

Fusselman et al.

[11] Patent Number: 5,415,567

[45] Date of Patent: May 16, 1995

[54] WIRE MANAGEMENT ADAPTERS FOR TERMINATING A CABLE

[75] Inventors: David F. Fusselman, Middletown; Peter K. Townsend, Camp Hill, both of Pa.

[73] Assignee: Berg Technology, Inc., Reno, Nev.

[21] Appl. No.: 255,574

[22] Filed: Jun. 8, 1994

Related U.S. Application Data

[63] Continuation of Ser. No. 51,827, Apr. 26, 1993, abandoned.

[51] Int. Cl.[6] ..... H01R 17/04

[52] U.S. Cl. ..... 439/344; 439/578; 439/719; 439/494

[58] Field of Search ..... 439/578–585, 439/675, 719, 492–499, 456–459

[56] References Cited

U.S. PATENT DOCUMENTS

| | | | |
|---|---|---|---|
| 3,696,319 | 10/1972 | Olsson | 339/17 |
| 4,005,921 | 2/1977 | Hadden et al. | 339/14 |
| 4,416,501 | 11/1983 | Fusselman et al. | 439/394 |
| 4,605,276 | 8/1986 | Hasircoglu | 339/176 |
| 4,679,868 | 7/1987 | Hasircoglu | 439/495 |
| 4,723,916 | 2/1988 | Fusselman et al. | 439/607 |
| 4,735,582 | 4/1988 | Fusselman et al. | 439/329 |
| 4,749,371 | 6/1988 | Hirai et al. | 439/497 |
| 4,753,005 | 6/1988 | Hasircoglu | 29/829 |
| 4,767,357 | 8/1988 | Hasircoglu | 439/499 |
| 4,824,383 | 4/1989 | Lemke | 439/108 |
| 4,892,489 | 1/1990 | Hirai | 438/497 |
| 4,902,236 | 2/1990 | Hasircoglu | 439/77 |
| 5,015,197 | 5/1991 | Redmond et al. | 439/329 |
| 5,055,068 | 10/1991 | Machura et al. | 439/581 |
| 5,057,028 | 10/1991 | Lemke et al. | 439/101 |
| 5,100,342 | 3/1992 | Olsson | 439/494 |
| 5,110,306 | 5/1992 | Buck et al. | 439/497 |
| 5,137,469 | 8/1992 | Carpenter et al. | 439/578 |
| 5,169,324 | 12/1992 | Lemke et al. | 439/101 |
| 5,256,082 | 10/1993 | Yaegashi et al. | 439/394 |

OTHER PUBLICATIONS

DuPont Product Catalog A, Feb. 1992, pp. 3–0 through 3–4.

*Primary Examiner*—David L. Pirlot
*Attorney, Agent, or Firm*—Woodcock Washburn Kurtz Mackiewicz & Norris

[57] ABSTRACT

A wire management adapter for organizing wires for presentment to a connector include a member having an array of grooves at the leading edge thereof. In one aspect, guideways are provided for positioning the wires of a cable for receipt within the grooves. The guideways accept both standard and coaxial conductors. A pocket carries a clip with insulation displacement tines to contact the braid of the coaxial conductor. In a second aspect, the member has alternating arrays of shallow and deeper grooves on each surface. The shallow and deeper grooves on each surface communicate with each other via a groove in the leading edge of the member. The shallow and deeper grooves on each surface register with the respective deeper and shallow grooves on the other surface.

7 Claims, 9 Drawing Sheets

WIRE MANAGEMENT ADAPTERS FOR TERMINATING A CABLE

This is a continuation of application Ser. No. 08/051,827, filed Apr. 26, 1993 now abandoned.

BACKGROUND OF THE INVENTION

1. Field of the Invention

The present invention relates to a wire management adapter for use in terminating a cable to a connector.

2. Description of the Prior Art

Wire management devices for organizing and presenting wires to a connector are known in the art. Representative of such devices are those disclosed in U.S. Pat. Nos. 3,696,319 (Olsson), 4,005,921 (Hadden et al.), 4,735,582 (Fusselman et al.), all assigned to the assignee of the present invention, U.S. Pat. Nos. 4,749,371 (Harai et al.), and 4,892,489 (Harai).

U.S. Pat. Nos. 4,824,383 (Lemke), 5,057,028 (Lemke et al.), and 5,169,324 (Lemke et al.), all assigned to the assignee of the present invention, disclose a connector having tails emanating from a housing thereof. U.S. Pat. No. 5,137,469 (Hasircoglu) shows a connector adapter for use in a daisy chain connector.

U.S. Pat. Nos. 5,137,469 (Carpenter et al.) and 5,055,068 (Machura et al.) disclose a connector for coaxial cable.

SUMMARY OF THE INVENTION

In a first aspect the present invention relates to a wire management arrangement for organizing the conductors of a coaxial cable for presentation to a connector. The cable has a plurality of jacketed conductors each of which has a wire therein and at least one jacketed coaxial conductor having a central wire with a surrounding braid. In accordance with this aspect of the invention the wire management arrangement includes a wire management adapter having a generally planar surface with a leading edge thereon. An array of alternately disposed lands and grooves is formed transversely across the surface of the adapter adjacent to the leading edge. Each groove has an axis therethrough. A plurality of partitions are disposed transversely across the surface of the adapter, the partitions being spaced from the leading edge and lying behind the array of lands and grooves. Adjacent partitions cooperate to define guideways, with each guideway having an axis therethrough. The axis of each guideway aligns collinearly with the axis of a groove. Some of the guideways are sized to accept a jacketed conductor, with at least one guideway being sized to accept a braided coaxial conductor. A pocket is formed in the planar surface of the adapter between the array of lands and grooves and the coaxial conductor guideway. A clip having at least one pair of insulation displacement tines is disposed in the pocket. The insulation displacement tines of the clip register with and partially close the mouth of the coaxial conductor guideway.

In use, insertion of a jacketed conductor into a guideway sized therefor serves to position the wire in that conductor for receipt by the groove whose axis is collinear with the axis of that guideway. Also, while in use, as the jacket of a braided coaxial conductor is inserted into the guideway sized for its receipt the insulation displacement tines of the clip contact the braid of the coaxial conductor. Simultaneously, the guideway itself serves to position the central wire of the coaxial conductor for receipt by the groove whose axis is collinear with the axis of the coaxial conductor guideway.

Each groove has an inclined ramp portion disposed adjacent to the leading edge of the adapter. The inclined ramp portion of the groove assists in guiding a cutting element in severing any excess wire that extends forwardly past the leading edge of the adapter. In the event the housing of the connector is fabricated of a conductive material, standoffs are provided on the adapter to prevent electrical contact between any portion of the severed wire and the connector housing.

In another aspect of the invention a wire management adapter also has a leading edge, a trailing edge, and first and second opposed, generally planar, surfaces thereon. Both the first and the second surfaces of the wire management adapter have an array of lands each with a top surface thereon. The top of each land is scalloped to define a shallow groove. Each land cooperates with an adjacent land to define a deeper groove. The shallow grooves and the deeper grooves are alternately arrayed transversely across the leading edge of the adapter. The shallow and the deeper grooves on the first and second surfaces are positioned such that all of the shallow grooves on the one surface register with a respective corresponding deeper groove located on the other surface and all of the deeper grooves on one surface register with a respective corresponding shallow groove disposed on the other surface. The leading edge of the adapter has a plurality of grooves thereon linking the each shallow and each deeper groove on one surface with its respective corresponding deeper and shallow groove on the other surface. Each land is spaced a distance above the surface of the adapter on which the land is disposed, thereby to define a shoulder which serves to position the jacket of a cable.

The adapter has side edges extending between the leading and trailing edges thereon, Each of the side edges has a slot formed therein. A grounding clip having a pair of arm thereon is receivable on the adapter, with each arm of the grounding member being received in a respective slot of the adapter.

In use, an exposed portion of the wires of a flat cable organized such that the exposed portion is received in a shallow groove on one surface of the adapter, and is guided by the groove at the leading edge of the adapter into the associated deeper groove on the other surface of the adapter. Thus, the portion of each wire supported in a shallow groove in a given land on one surface of the adapter is able to be contacted by a terminal from a connector and may there secured. However, each exposed wire received in the adjacent deeper grooves is recessed and shielded from contact with the terminals of the connector.

BRIEF DESCRIPTION OF THE DRAWINGS

The invention will be more fully understood from the following detailed description thereof taken in connection with the accompanying drawings, which form a part of this application and in which:

FIGS. 6 is a plan view of an insulation displacement grounding clip used with the wire management adapter of FIGS. 1 through 5 while

DETAILED DESCRIPTION OF THE INVENTION

Figure 1:
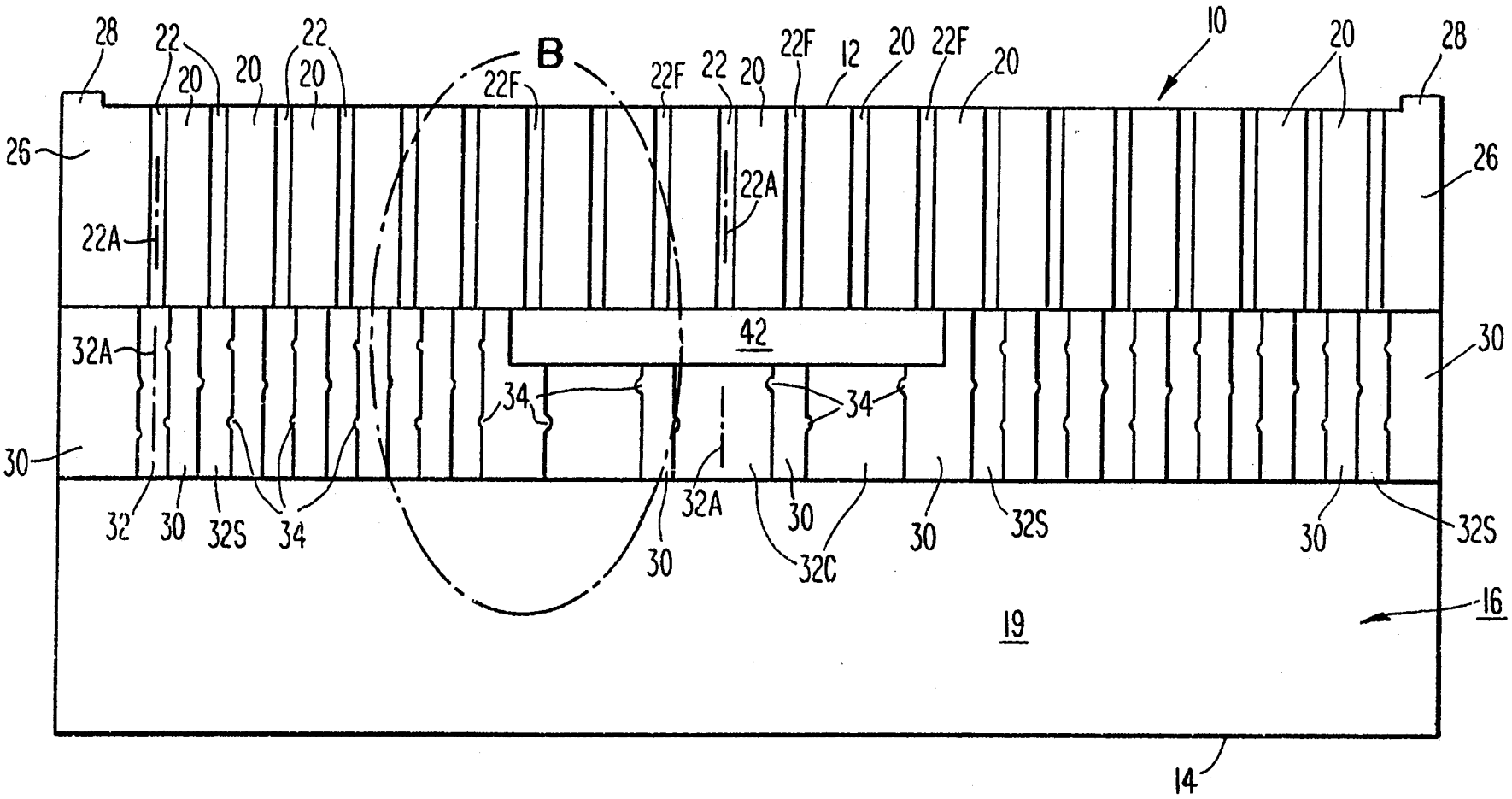
FIG. 1 is a plan view of a wire management adapter in accordance with a first aspect of the present invention.

Throughout the following detailed description similar reference numerals refer to similar elements in all figures of the drawings.

In a first aspect the present invention is directed to a wire management arrangement especially adapted for use in organizing the jacketed conductors and jacketed coaxial conductors of a cable for presentation to and interconnection with the terminal tails emanating from the housing of a connector. As will be developed the wire management arrangement may be used with either round or flat cables having both plural jacketed conductors and plural coaxial conductors.

The wire management arrangement includes a wire management adapter, or block, 10 (FIGS. 1 to 5, 9) and a clip 44 (FIGS. 6 to 9) of the insulation displacement type. The adapter 10 has a leading edge 12, a trailing edge 14 and respective upper and lower surfaces 16, 18 (FIG. 2) extending therebetween. The surfaces 16, 18 are generally planar in configuration. The thickness dimension of the adapter 10 is reduced in the vicinity of the trailing edge 16 thereof to define on each surface 16, 18 a smooth, open shelf region 19.

The first surfaces 16 of the wire management adapter 10 has an array of generally parallel, alternately disposed lands 20 and grooves 22. The lands 20 and grooves 22 extend transversely across the adapter 10 adjacent to the leading edge 12. Adjacent lands 20 cooperate to define the grooves 22. Each groove 22 has an axis 22A therethrough. Abutments 26 on the adapter 10 cooperate with the extreme lateral lands 20 to form grooves 22 at each lateral end of the array. A portion 28 of the abutments 26 may extend forwardly past the leading edge of the adapter 10. In this position, the extending portions 28 define standoffs for a purpose to be described.

Extending transversely across the portion of the upper surface 16 of the adapter 10 generally midway between the leading and trailing edges thereof is an array of partitions 30. The partitions 30 lie adjacent to each other and cooperate to define guideways 32. The transverse spacing between adjacent the sidewalls of the partitions 30 defines the width of the guideways 32. As will be made clearer herein the guideways 32 are sized to accept the jacketed portions of the conductors of a cable. Relatively narrow sized guideways, e.g., the guideways 32S, are adapted to accept the jackets of standard conductors (i.e., non-shielded conductors having single or multiple central wire strands). Wider guideways, e.g., the guideways 32C, are sized to accept the braided coaxial conductors. The axis 32A of each guideway 32S, 32C, as the case may be, align collinearly with the axis 22A of a respective groove 22. Additional grooves 22F are provided for a purpose to be described in adjacency to the partitions 30 defining the guideways 32C. Retention features 34 formed on the sidewalls of the partitions within the guideways 32 assist in grasping the conductors received therein.

Figure 2:
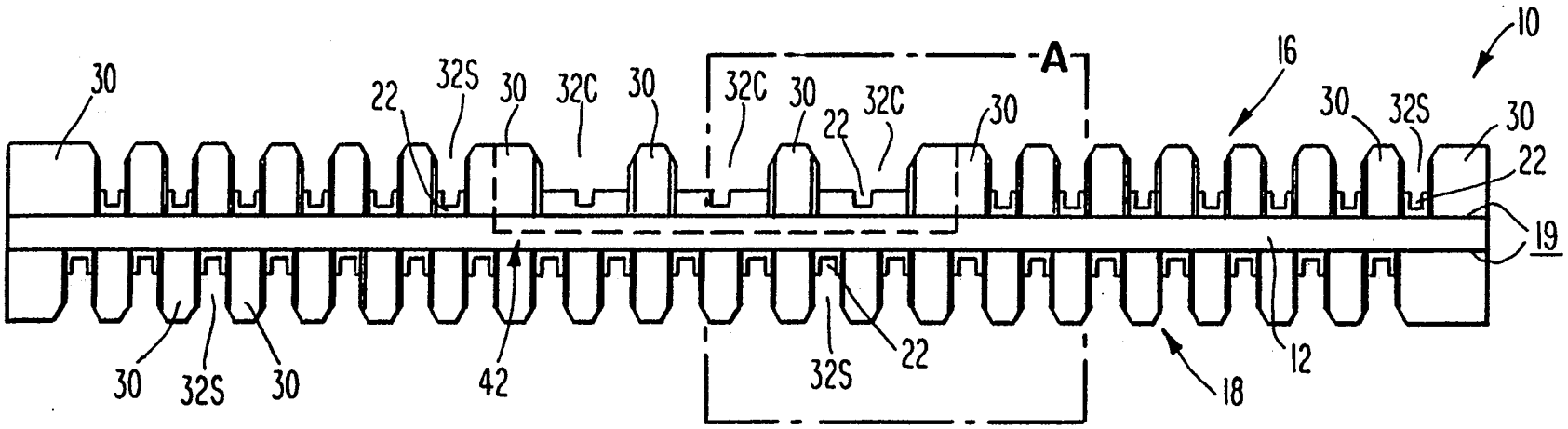
FIG. 2 is a front elevational view of the wire management adapter of FIG. 1.
Figure 4:
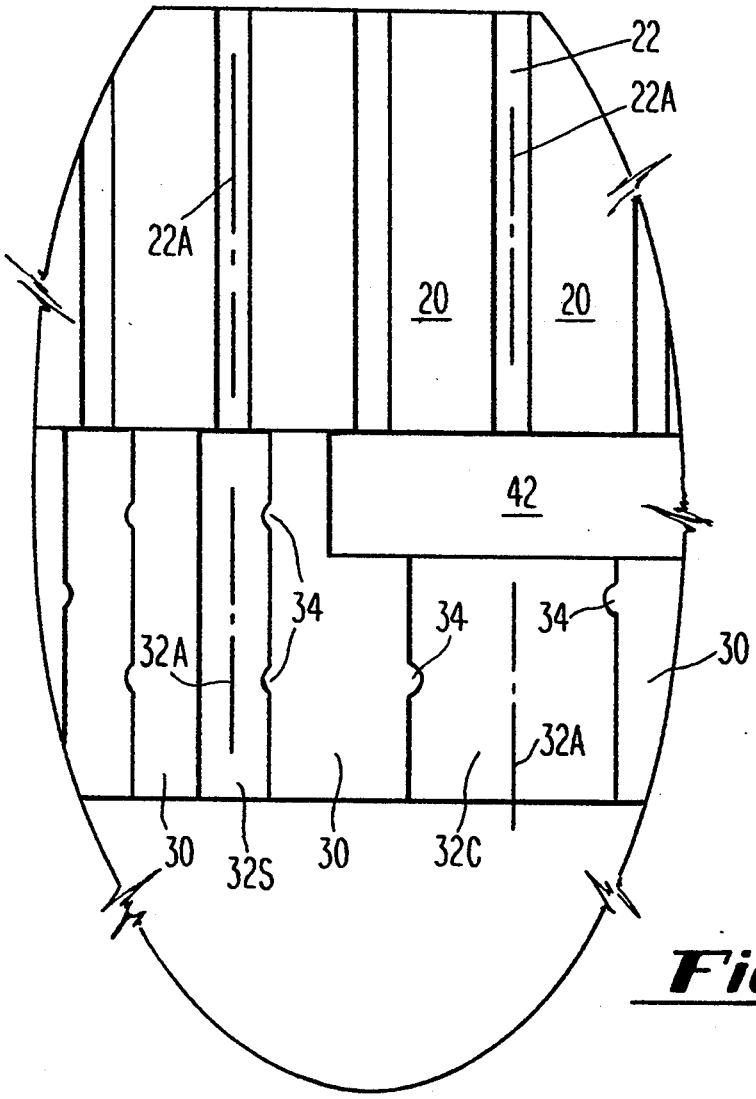
FIG. 4 is an enlarged view of detail "B" as indicated in FIG. 1.
Figure 3:
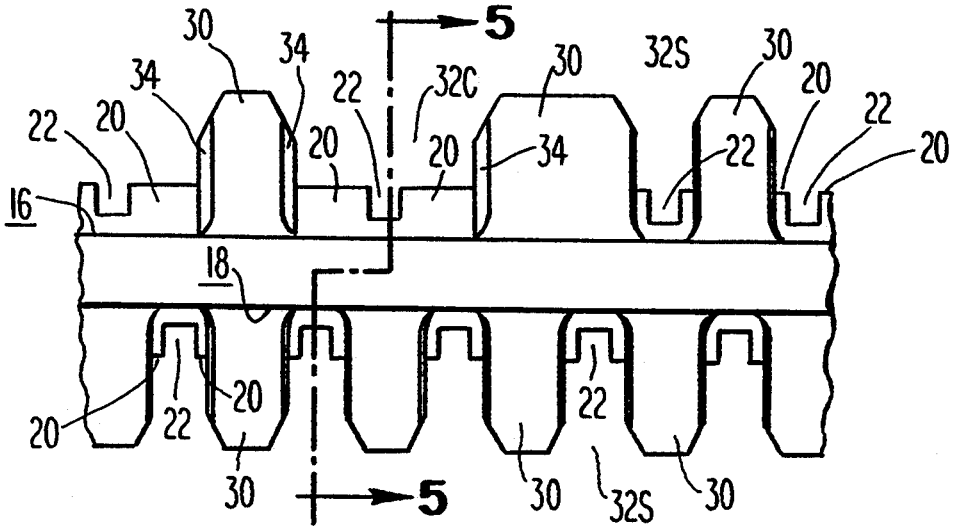
FIG. 3 is an enlarged view of detail "A" as indicated in FIG. 2.

In accordance with the first aspect of the invention, the upper surface 16 of the adapter 10 has a pocket 42 formed therein. The pocket 42 is located between the array of lands 20 and grooves 22 and the guideways 32C sized to receive the coaxial conductors. The pocket 42 is recessed below the surface 16 (FIG. 2). The pocket 42 is sized to receive the clip 44.

Figure 8:
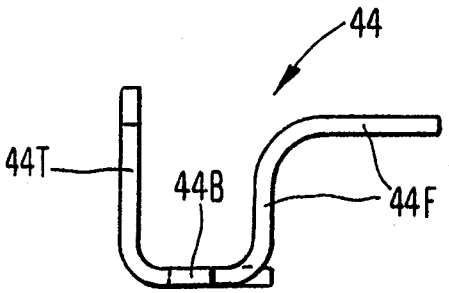
FIGS. 7 and 8 are, respectively front and side elevation views of the clip.
Figure 7:
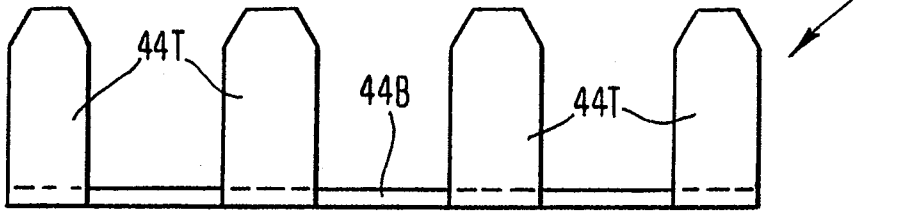
Figure 6:
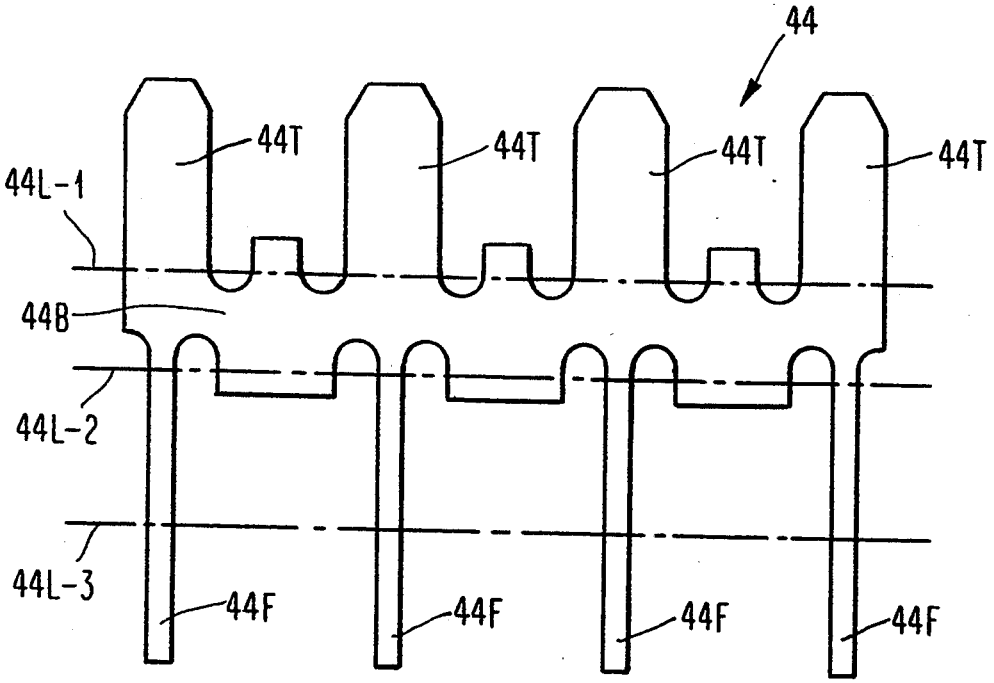

The structure of the clip 44 is shown in FIGS. 6 through 8. FIG. 6 is a plan view of a blank for the clip 44. The clip 44 includes a base portion 44B from which extend tines 44T and fingers 44F. The tines 44T are folded along a fold line 44L-1 to upstand from the base portion 44B, as seen in FIGS. 7 and 8. When folded the confronting edges of adjacent tines 44T pair to define insulation displacement edges. In addition the fingers 44F are themselves bent along two fold lines 44L-2, 44L-3 to impart a generally cup-shaped configuration to the clip 44, as best seen in FIG. 8.

Figure 9:
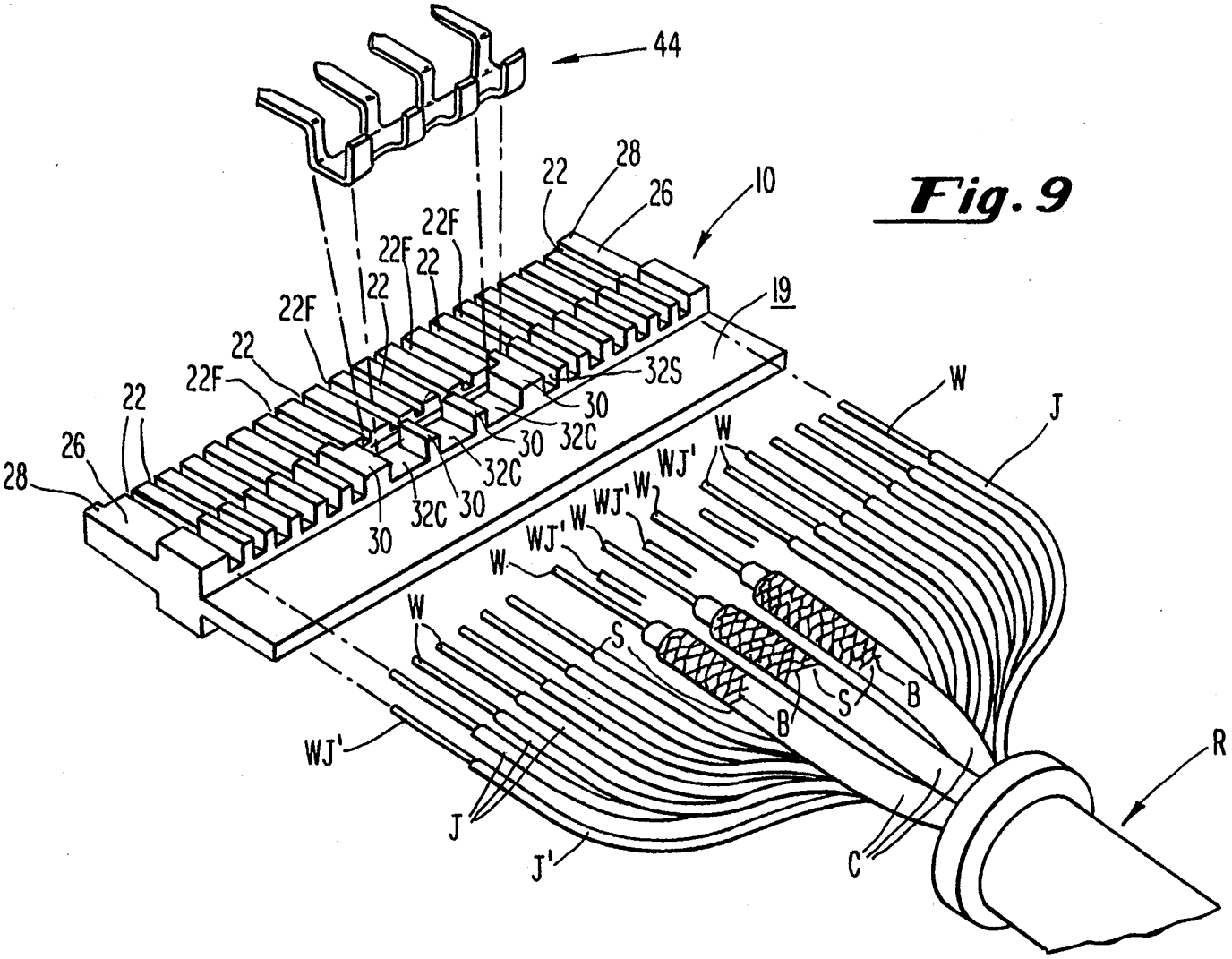
FIG. 9 is an exploded perspective view of a wire management adapter in accordance with the present invention in use in presenting the wire of a cable to a connector.

In use, as may be understood with reference to FIG. 9, the base portion 44B of the clip 44 is received within the pocket 42. The underside of the base portion 44B bottoms against the floor of the pocket 42. When the base 44B is received within the pocket 42, each adjacent pair of insulation displacement tines 44T is positioned to close partially the mouth of the guideway 32C to which the pair of tines is proximal. When seated in the pocket the fingers 44F of the clip 44 are received in the grooves 22F.

FIG. 9 illustrates how the wire management arrangement organizes the jacketed conductors J and the jacketed braided coaxial conductors C of a round cable R for presentment to a connector. The jacket of the cable R is removed a distance from the end thereof to expose the conductors J and C. The conductors J and C are formed into a planar array that is received on the shelf 26. The jackets of the conductors J and C are themselves stripped a distance from their end, as indicated at S, whereby the individual wire(s) W of the conductors J and the central wire W and braid B of the coaxial conductor C are exposed. The wires W are cut to a length such that the ends of the wires are approximately coextensive with the leading edge 12 of the adapter 10. Some trimming may be required, as is discussed herein. If a flat cable is being organized, the conductors J, (and C, if provided) therein are already formed in a planar array. The conductors thus need only be stripped for use with the wire management adapter of this aspect of the invention.

The jackets of the standard conductors J are inserted into the guideways 32S and are retained therein by the features 34. In this disposition the wires W of the conductors J are positioned for receipt by the groove 22 whose axis 22A is collinear with the axis 32A of the guideway 32 in which the conductor J is received. Moreover, as the braid B of the coaxial conductor C is inserted into the guideway 32C the edges of the insulation displacement tines 44T make electrical contact with the braid B. The guideway 32C thus serves to position the central wire W of the coaxial conductor C for receipt within the groove 22 whose axis 22A is aligned with the guideway 32C receiving the coaxial conductor C.

If additional jacketed conductors J' are carried within the cable R, a planar array of the wires WJ' of these additional conductors J' may be accommodated on the lower surface 18 of the adapter 10. To this end the surface 18 is provided with an array of lands 20 and grooves 22, and well as partitions 30 and the associated guideways 32 defined thereby. Since the coaxial conductors are accommodated on the upper surface 16 of the adapter 10 the lower surface 18 thereof need only be arranged to provide grooves 22 and guideways 32S to receive standard conductors J. The resulting appearance of the lands, 20, grooves 22, partitions 30 and guideways 32S on the lower surface 18 is thus similar to that shown in FIG. 1, with the enlarged guideways 32C and the pocket 42 being omitted as unnecessary. It should be understood, however, that if desired, the surface 18 may be configured similar to the surface 16, whereby the surface 18 may accommodate both form of standard jacketed conductors and coaxial conductors.

Figure 5:
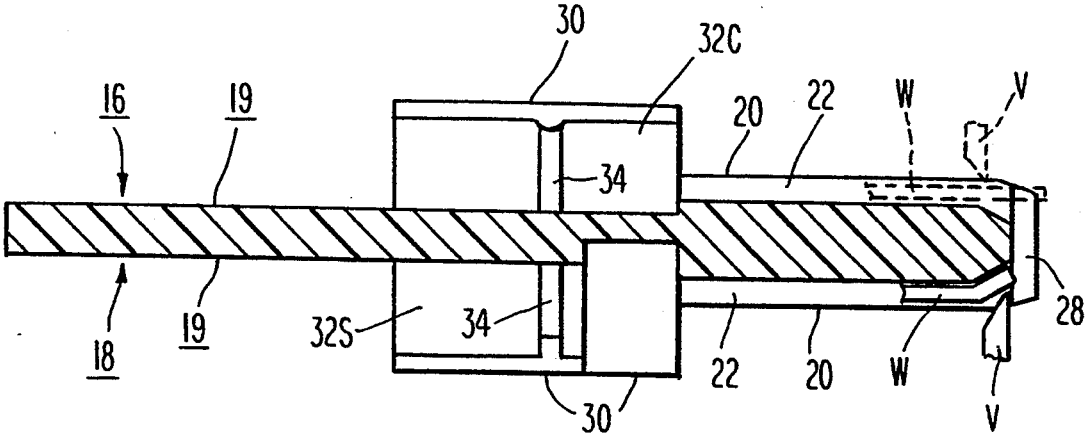
FIG. 5 is a side sectional view, taken along section lines 5—5 of FIG. 3.

As is best seen in FIG. 5 the material of the adapter defining the base of each groove 22 on each surface 16, 18 has an inclined ramp portion 22R disposed adjacent to the leading edge 12 of the adapter 10. These inclined ramps 22R serves to assist trimming blades V in severing any portion of the wires W of the conductors J or C (supported on the upper surface 16 of the adapter) or conductors J' (supported on the lower surface 18), as the case may be, that extend past the leading edge 12 of the adapter 10. The dashed lines in FIG. 5 illustrate the disposition of the wires W prior to trimming. As the blades V close on the leading edge of the adapter (in the direction of the arrows) the wires bend to conform to the surface of the ramps 22R, as shown by the solid lines in that Figure. This action assists in the trimming the wires W flush with the leading edge 12 of the adapter 10.

As the trimming blades V wear the cut produced thereby may not remain as clean as when the blade is first used. Thus, some material of a raggedly cut wires may fray and be drawn over the facing surface of the leading edge of the adapter. If the connector housing to which the wires are being presented is fabricated from a conductive material (as is the case in the above-referenced Lemke and Lemke et al. patents) and the raggedly cut ends of the wires touch the same, a short circuit would occur. The standoffs defined by the extending portions 28 of the abutments 26 serve to space the leading edge 12 of the adapter from the housing of the connector, thus precluding the occurrence of a short circuit.

In the preferred case, the adapter 10 is molded from a suitable insulating material, as a liquid crystal polymer material. The clip 44 is fabricated from a copper blended material.

Figure 10:
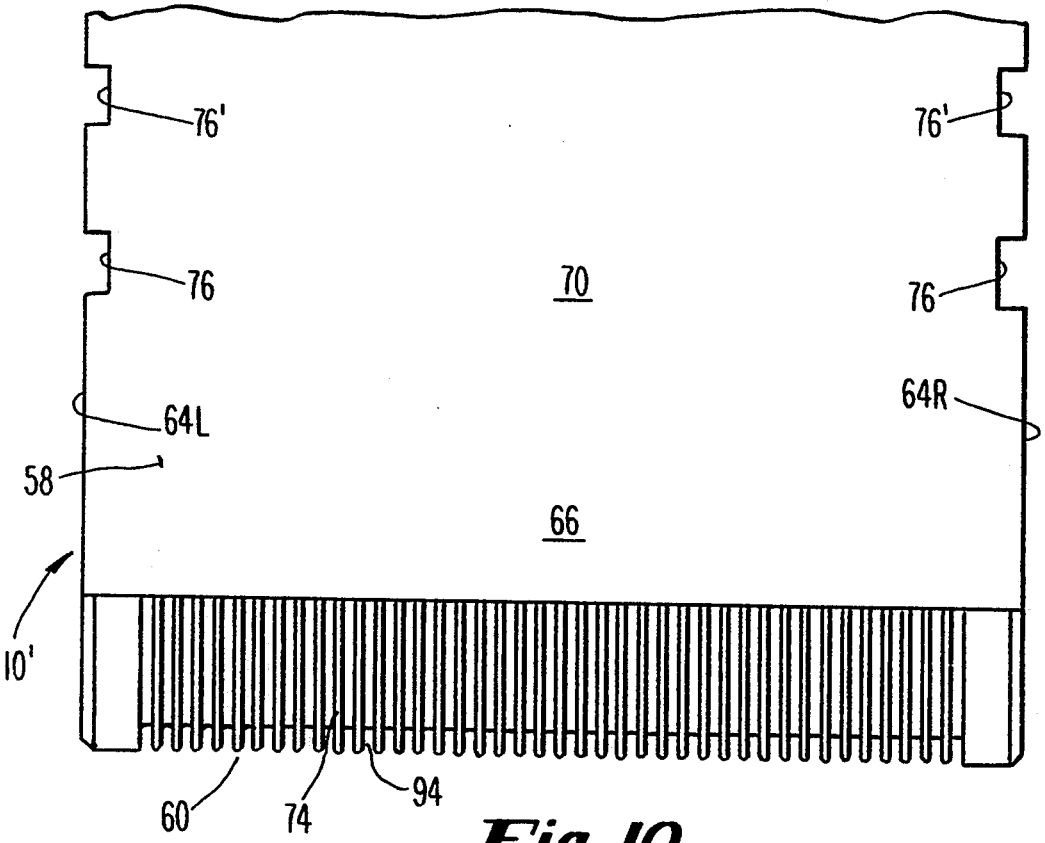
FIG. 10 is a plan view of a portion of a wire management adapter in accordance with a second aspect of the present invention.
Figure 11:
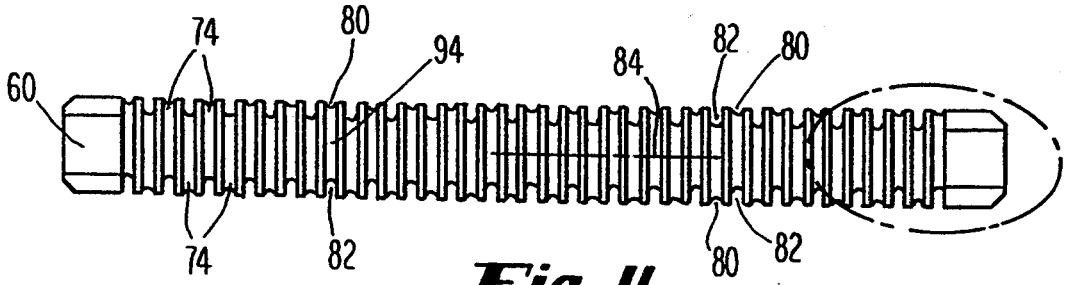
FIG. 11 is a front elevation view of the adapter of FIG. 10.
Figure 12:
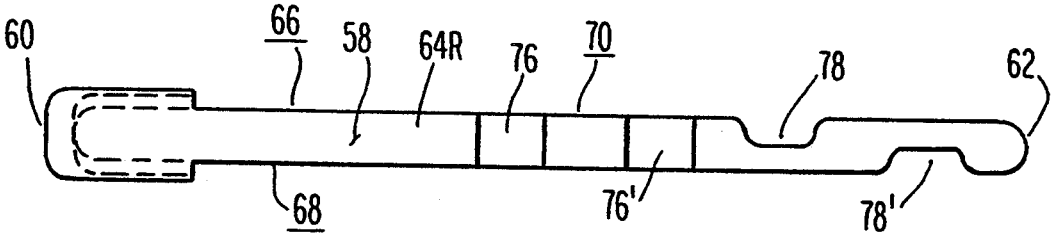
FIG. 12 is a full side elevation view of the adapter of FIG. 10.

FIGS. 10 through 15 illustrate a wire management arrangement in accordance with a second aspect of the present invention. FIGS. 10 through 12 illustrate a wire management adapter, or block, 10' used with this aspect of the present invention. As will be developed this form of the adapter 10' is especially useful in forming "daisy chain" interconnections in which jacketed fiat cable is stripped and "dressed" around the wire management adapter.

The adapter 10' is an integral generally planar member molded from an insulating material, such as the same material used for the adapter 10. The adapter 10' has a body portion 58 with a leading edge 60, a trailing edge 62, side edges 64L, 64R, and upper and lower planar surface 66, 68. The major portion of the area of each surface 66, 68 defines a shelf 70 for receipt of a flat cable F (FIGS. 14, 15).

At the leading edge 60 of the adapter 10' each surface 66, 68 has an array of lands 74 extending transversely thereacross. The lands 74 are enlarged with respect to the thickness dimension of the body 58 of the adapter 10', such that the trailing end of each land 74 is spaced above the shelf portion 70 of the adapter 10'. The trailing end of each land 74 thus defines a shoulder 74S (FIG. 14) for a purpose to be described. Corresponding pairs of slots 76 (and 76') are provided along the side edges 64L, 64R of the adapter 10. In addition, suitable strain relief grooves 78, 78' are formed in the shelf regions 70 on each surface of the adapter 10' near the trailing edge 62.

Each land 74 has a top surface 74T that is scalloped to define a shallow groove 80. Adjacent lands 74 cooperate to define relatively deeper grooves 82. Accordingly, across each surface 66, 68, shallow grooves 80 and deeper grooves 82 are alternately arrayed. With respect to a reference datum 84 extending centrally (and, as viewed in FIGS. 11 and 13, horizontally) through the body of the adapter 10', the base of each shallow groove 80 is spaced a greater distance 86 from the datum 84 than the distance 88 by which the base of each deeper groove 82 is spaced from that same datum 84.

Figure 14:
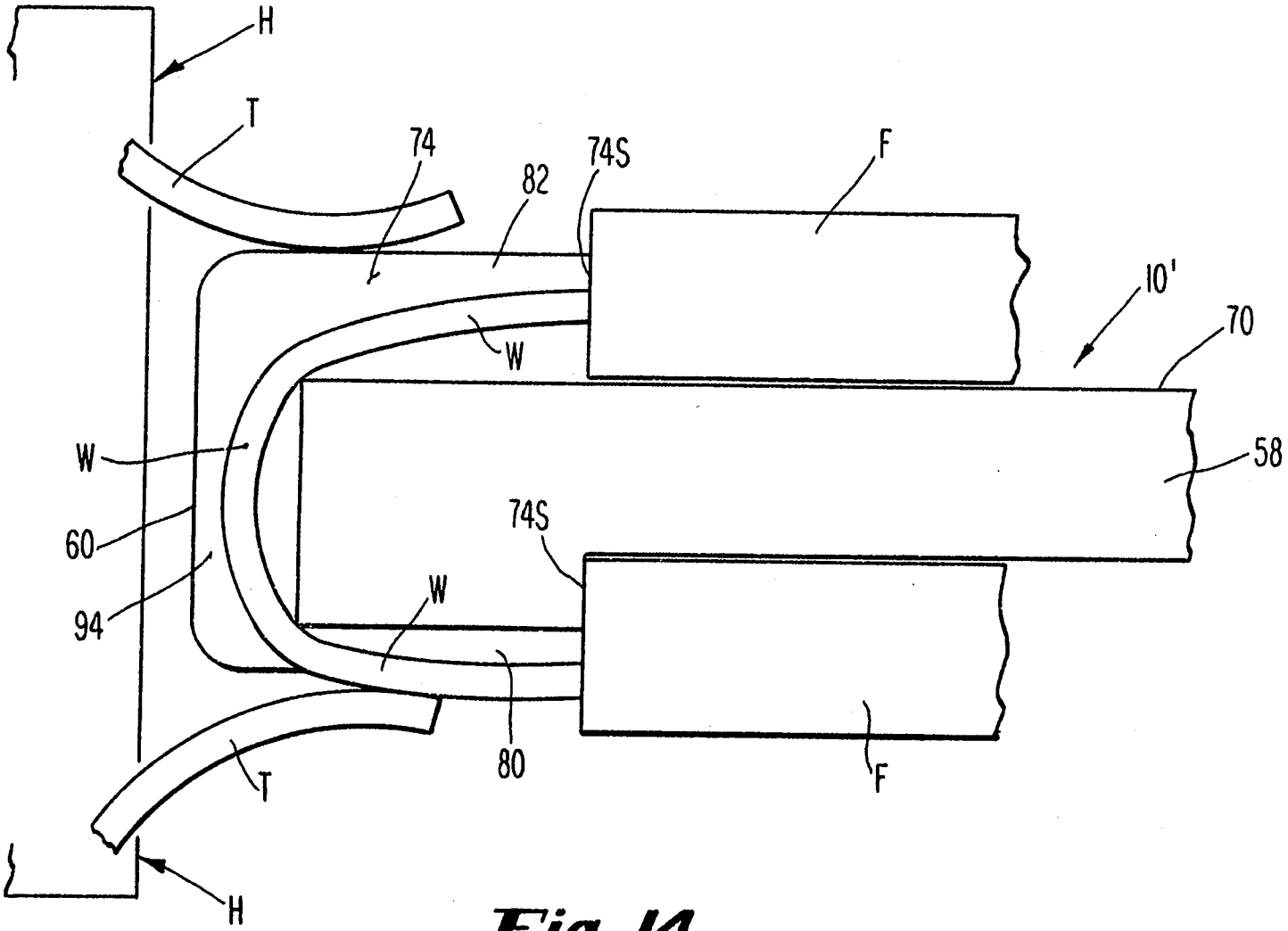
FIGS. 14 and 15 are, respectively, a side elevational and a perspective view of the adapter of FIG. 10 while in use in organizing the conductors of a fiat cable for presentation to the terminals of a connector.
Figure 15:
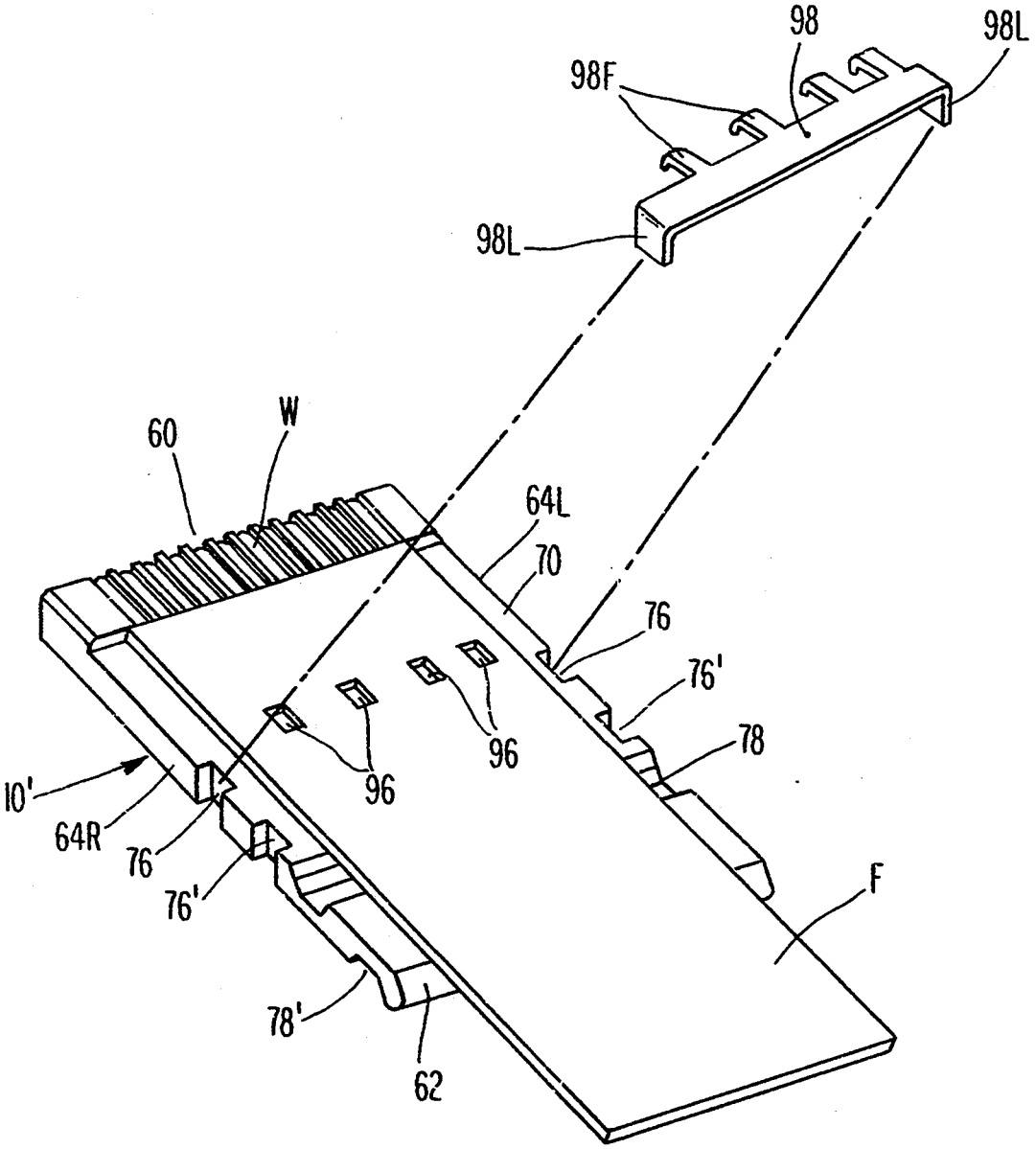

As is best seen in FIGS. 11 and 14, the shallow grooves 80 and the deeper grooves 82 on the both of the surfaces 66, 68 are positioned such that: all of the shallow grooves 80 on one surface register with a respective corresponding deeper groove 82 disposed on the other surface; and all of the deeper grooves 82 on the one surface register with a respective corresponding shallow groove 80 disposed on the other surface. The registration of the grooves as just described is defined in accordance with a reference axis 92 that extends perpendicular to the surfaces 66, 68 and through the paired shallow groove 80 and deeper groove 82.

In addition, the frontal surface of the leading edge 60 of the adapter 10' is grooved, as at 94, whereby each shallow groove 80 may communicate with its associated deeper groove 82.

In use, as is best seen in FIGS. 14 and 15, the adapter 10' operates to organize the wires of a flat cable C for presentment to and interconnection with tails T of terminals extending from a housing H of a connector. Preferably, the connector C is a connector as disclosed in the above-referenced Lemke and Lemke et al. patents. The tails T emanate from the housing H of the connector and define upper and lower, generally linear, arrays of tails. Each tail T in the upper array is staggered, or laterally offset, with respect to the tails T in the lower array, as is suggested in FIG. 13.

Figure 13:
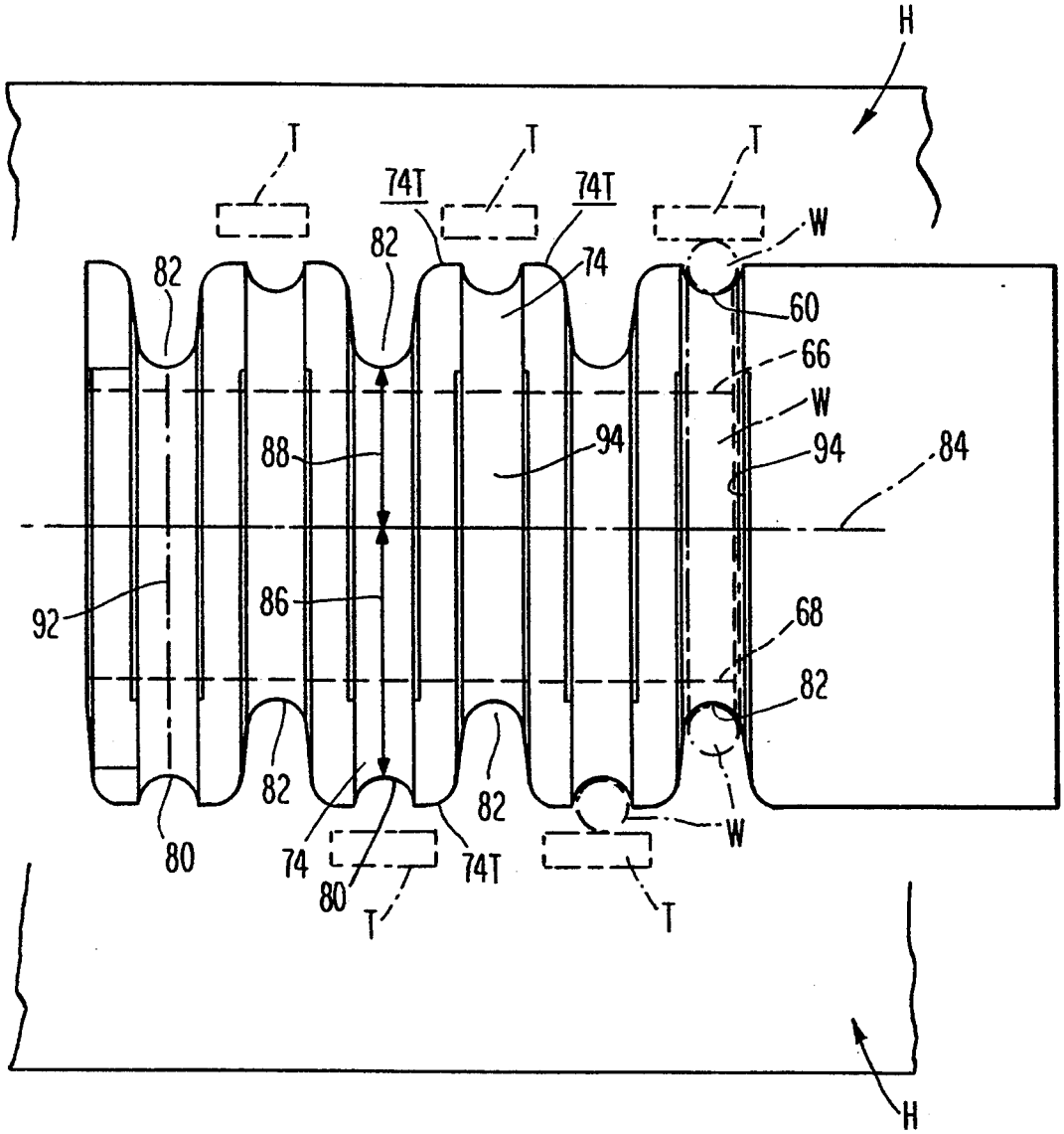
FIG. 13 is an enlarged front elevation view of the circled portion of the front view of the adapter as shown FIG. 11.

To prepare the cable for use with the adapter, a portion of the jacket of the cable F is removed, thereby to expose a length of each wire W therein. The edges of the remaining jacket define shoulders which abut against the shoulders 74S defined by the trailing ends of the lands 74 (FIG. 14), thus positioning the exposed wires W for receipt in the grooves 80, 82, and 94. As is best seen in FIGS. 13 and 14, the exposed portion of each wire W is received in a shallow groove 80 on one surface of the adapter 10', and is guided by the groove 94 around the leading edge 60 of the adapter 10' and into the associated deeper groove 82 on the other surface of the adapter 10' The portion of each wire W supported in a shallow groove 80 on one surface of the adapter 10' is able to be contacted by a terminal T from the connector and may there be soldered or otherwise secured. However, the wires W received in the adjacent deeper grooves 82 on are recessed and shielded from contact with the terminals. The cable, as wrapped about the front edge of the adapter, is secured using the strain relief 78.

In some instances it may be desired to connect some of the wires W in the cable F to ground. To effect this interconnection, windows 96 (FIG. 15) are suitably formed, as by laser ablation, in the jacket of the cable F to expose selected wires W. A grounding bar 98, having contact fingers 98F and mounting legs 98L at each end thereof, may be used to contact the selected wires exposed by the windows 96. The legs 98L of the bar 98 are received in a pair of slots (e.g., the slots 76) to secure the bar to the adapter 10'. The fingers 98F extend through the windows 96 and contact the wires.

In addition to using the adapter 10' to effect a daisy chain configuration (in which a single cable is wrapped about its leading edge, as heretofore described) the adapter 10' may alternatively be used to organize the wires in a flat cable received on each surface 66, 68 thereof. Wires of each cable to be supported are first cut to a length such that the ends of the wires align with the front edge of the adapter 10' when mounted thereon. Wires received on each surface are thus supported in the shallow grooves on that surface, but do not wrap around the leading edge of the adapter 10'. A grounding clip for one surface would utilize the paired slots 76, while a separate clip for the cable on the opposite surface would utilize the paired slots 76'. Similarly, a separate strain relief arrangement may be used, each employing a separate groove 78, 78'.

Those skilled in the art, having the teachings of the present invention as hereinabove set forth, may effect numerous modifications thereto. It should be understood that these and such modifications lie within the contemplation of the present invention, as defined by the appended claims.

What is claimed is:

1. A wire management arrangement for organizing the conductors of a cable for presentation to a connector, the cable having a plurality of jacketed conductors each having a wire therein and at least one jacketed and braided coaxial conductor having a central wire therein, the wire management arrangement comprising:

a wire management adapter having a generally planar surface with a leading edge thereon, an array of alternately disposed lands and grooves formed transversely across the surface of the adapter adjacent to the leading edge, each groove having an axis therethrough, a plurality of partitions disposed transversely across the surface of the adapter, the partitions being spaced from the leading edge, adjacent partitions cooperating to define guideways, each guideway having an axis therethrough, the axis of each guideway aligning collinearly with the axis of a groove, some of the guideways being sized to accept a jacketed conductor, with at least one guideway being sized to accept a braided coaxial conductor, a pocket formed in the planar surface of the adapter between the array of lands and grooves and the guideway sized to accept the braided coaxial conductor, a clip disposed in the pocket, the clip having at least one pair of insulation displacement tines, the insulation displacement tines of the clip registering with the guideway sized to accept the braided coaxial conductor, so that, in use, insertion of a jacketed conductor into a guideway sized therefor serves to position the wire in that jacketed conductor for receipt by the groove whose axis is collinear with the axis of that guideway, and so that, in use, the insulation displacement tines of the clip contact the braid of a coaxial conductor inserted into the guideway sized therefor, while the guideway serves to position the central wire of the coaxial conductor for receipt by the groove whose axis is collinear with the axis of that guideway.

2. The wire management arrangement of claim 1 wherein the clip has at least one finger thereon, the finger being receivable into a groove when the clip is disposed within the pocket.

3. The wire management arrangement of claim 1 wherein each groove has an inclined ramp portion disposed adjacent to the leading edge of the adapter.

4. The wire management arrangement of claim 1 further comprising a pair of standoffs disposed thereon.

5. A wire management adapter for organizing the signal and ground conductors of a cable for presentation to a connector, the connector having a housing with a plurality of tails extending from the housing, the tails being arranged to define upper and lower, generally linear, arrays of tails, the wire management adapter having a leading edge and first and second opposed, generally planar, surfaces thereon, both the first and the second surfaces of the wire management adapter having array of lands each having a top surface thereon, the top of each land being scalloped to define a shallow groove, each land cooperating with an adjacent land to define a deeper groove, whereby the shallow grooves and the deeper grooves are alternately arrayed transversely across the leading edge of the adapter, the shallow and the deeper grooves on the first and second surfaces being positioned such that all of the shallow grooves on the one surface register with a respective corresponding deeper groove disposed on the other surface and all of the deeper grooves on one surface register with a respective corresponding shallow groove disposed on the other surface, the leading edge of the adapter having a plurality of grooves thereon linking the each shallow and each deeper groove on one surface with its respective corresponding deeper and shallow groove on the other surface.

6. The wire management adapter of claim 5 wherein each the adapter has side edges extending between the leading and trailing edges thereof, each of the side edges having a slot formed therein, the slot being sized to receive a grounding clip.

7. The wire management adapter of claim 5 wherein each land has a trailing edge thereon, and wherein the trailing edge of each land is spaced a distance above the surface of the adapter on which the land is disposed.

* * * * *